US005961165A

United States Patent [19]

Aizawa et al.

[11] Patent Number: 5,961,165

[45] **Date of Patent: *Oct. 5, 1999**

[54] OUTER DOOR HANDLE STRUCTURE FOR VEHICULAR DOOR

[75] Inventors: Toru Aizawa, Tokyo; Yoshimitsu Takeda, Kanagawa-ken, both of Japan

[73] Assignee: Nissan Motor Co., Ltd., Yokohama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,380

[22] Filed: Sep. 27, 1996

[30] Foreign Application Priority Data

Sep. 27, 1995 [JP] Japan ..... 7-249695
Sep. 27, 1995 [JP] Japan ..... 7-249696

[51] Int. Cl.[6] ..... E05C 3/26

[52] U.S. Cl. ..... 292/336.3; 292/DIG. 23

[58] Field of Search ..... 292/336.3, DIG. 23, 292/DIG. 31, 347, 216, DIG. 53, DIG. 43, 169.11, DIG. 41

[56] References Cited

U.S. PATENT DOCUMENTS

| | | | |
|---|---|---|---|
| 3,781,045 | 12/1973 | Watermann | 292/216 |
| 3,799,596 | 3/1974 | Nozuma | 292/216 |
| 3,967,844 | 7/1976 | Torii | 292/336.3 |
| 4,052,094 | 10/1977 | Widen | 292/336.3 |
| 4,475,415 | 10/1984 | Yamamoto | 292/336.3 |
| 4,580,821 | 4/1986 | Genord | 292/336.3 |
| 4,588,219 | 5/1986 | Kobayashi | 292/DIG. 31 |
| 4,691,949 | 9/1987 | Grantz | 292/216 |
| 4,773,683 | 9/1988 | Nakamura | 292/216 |
| 4,813,722 | 3/1989 | Viscome | 292/216 |
| 4,858,973 | 8/1989 | Ogasawara | 292/DIG. 31 |
| 5,174,619 | 12/1992 | Bender | 292/336.3 |
| 5,309,745 | 5/1994 | Ursel | 70/264 |
| 5,340,174 | 8/1994 | Bender | 292/DIG. 31 |
| 5,560,659 | 10/1996 | Dault | 292/336.3 |
| 5,622,396 | 4/1997 | Neumann | 292/202 |

*Primary Examiner*—Steven Meyers
*Assistant Examiner*—Gary Estremsky
*Attorney, Agent, or Firm*—Foley & Lardner

[57] ABSTRACT

An outer door handle structure is operated as a directly operating system wherein an engaging piece of an unlocking lever for unlocking a door is directly depressed by the tip portion of an operating lever mounted on an outer door handle via an arm portion, so that any transmission mechanisms such as a rod can be omitted unlike conventional indirect operating systems. The arm portion has an inclined portion on which the engaging piece of the unlocking lever can slide up when a load is applied to the outer door handle from the outside.

The outer door handle may have a pair of arm portions spaced at an interval in a horizontal direction. One of the arm portions has a preset quantity of rotational stroke necessary to unlock the door, and the other arm portion has a greater quantity of rotational stroke than that of the one arm portion by forming a recessed portion in the other arm portion or the like.

4 Claims, 6 Drawing Sheets

OUTER DOOR HANDLE STRUCTURE FOR VEHICULAR DOOR

BACKGROUND OF THE INVENTION

1. Field of the Invention

The present invention relates to an outer door handle structure for a door, such as a back door and a side door, of an automotive vehicle.

2. Description of the Prior Art

A door, such as a back door and a side door, of an automotive vehicle is provided with an outer door handle. The door is designed to be unlocked by operating this outer door handle,(e.g. see Japanese Utility Model Laid-Open No. 5-64368).

In the case of a back door, this type of outer door handle is typically arranged at a middle-height portion of the back door. The operation force of the outer door handle is transmitted to a door lock arranged at the lower end portion of the back door via a transmission mechanism such as a rod, so as to operate the door lock.

However, since such a conventional outer door handle structure is an indirect operation system which uses a transmission mechanism such as a rod between the outer door handle and the door lock, the number of parts is great so as to increase the weight and the assembly manday.

In addition, this type of outer door handle is long sideways so as to be easy to be manually operated. The outer door handle is pivotably supported on two arm portions. When the outer door handle is pulled so as to rotate the arm portions, an operating lever mounted on one of the arm portions is rotated to transmit the rotational stroke of the operating lever to the door lock so as to unlock the door. Therefore, when the outer door handle is operated, it is important that the operating lever rotates by at least a stroke quantity necessary to unlock the door, and the quantity of rotational stoke of the outer door handle is so set as to fulfill this condition.

Thus, in such a conventional outer door handle structure, the two arm portions are designed to have the same quantity of rotational stroke as the quantities of rotational stroke necessary for the arm portions. However, if the operator holds a portion neighboring one end portion of the outer door handle on the side of the other arm portion on which the operating lever is not mounted, the operating force applied to the outer door handle by the operator may be biased toward the end portion of the outer door handle on the side of the other arm portion, and the whole outer door handle may be deformed so as to be twisted. Therefore, although the other arm portion to which the operating force is directly applied by the operator's hand may surely rotate by a preset stroke quantity, the one arm portion on which the operating lever is mounted can not sufficiently rotate due to the twist of the whole outer door handle, so that the actual quantity of rotational stroke may be insufficient. For that reason, the operating lever can not sufficiently rotate, and in the case of the worst, the door can not be surely unlocked.

Therefore, in order to prevent the outer door handle from being deformed so as to be twisted, it is required to change the material of the outer door handle to a hard zinc die-cast or to increase the sectional area of the arm portion to increase the strength thereof, so that the weight and cost of the outer door handle are increased.

Alternatively, the quantities of rotational stroke of the arm portions may be set to be largish. That is, the quantities of rotational stroke of both arm portions are set to be sufficiently greater than the necessary quantities of rotational stroke so that one of the arm portions can rotate by the necessary quantity of rotational stroke even if the outer door handle is twisted. Thus, even if the one arm portion can not sufficiently rotate, it is possible to ensure the rotational stroke necessary to unlock the door. However, in this method, since the preset quantity of rotational stroke is great, the space occupied by the arm portions is increased to decrease the space for other parts inside of the door, so that it is difficult to design the door lock and other devices inside of the door.

SUMMARY OF THE INVENTION

It is therefore an object of the present invention to provide an outer door handle structure for a door such as a back door of an automotive vehicle, which can be operated as a direct operation system without the need of any transmission mechanisms such as a rod, and which can decrease the number of parts.

It is another object of the present invention to provide an outer door handle structure for a vehicular door, which can ensure the quantity of rotational stroke necessary to unlock the door even if the outer door handle is twisted.

It is a further object of the present invention to provide an outer door handle structure for a vehicular door, which can ensure the quantity of rotational stroke necessary to unlock the door without increasing the space occupied by arm portions.

In order to accomplish the aforementioned and other objects, according to one aspect of the present invention, an outer door handle structure for a door of an automotive vehicle, comprises: a manually operable outer door handle mounted on an outer panel of a door of an automotive vehicle; an arm portion which is located inside of the outer panel and one end of which is secured to the outer door handle, the arm portion having an inclined portion which is inclined so as to extend upwards while extending toward the outer panel when the outer door handle is not operated; an unlocking lever having an engaging piece which extends toward the arm portion and which faces the inclined portion of the arm portion, the unlocking lever being associated with a door lock for unlocking the door when the engaging piece of the unlocking lever is depressed; and an operating lever, the base end portion of which is pivotably supported on the other end of the arm portion, the operating lever being pivotable so that the engaging piece of the unlocking lever is directly depressed by the free end portion of the operating lever when the outer door handle is operated.

Since this outer door handle structure can be operated as a directly operating system wherein the engaging piece of the unlocking lever is depressed by the tip portion of the operating lever mounted on the arm portion, it is possible to omit any transmission mechanisms such as a rod necessary for conventional outer door handles operated as indirectly operating systems, so that it is possible to decrease the number of parts and the weight thereof. In addition, since the engaging piece of the unlocking lever can slide up on the inclined portion of the arm portion when a load is applied to the outer door handle from the outside, the deformation of the unlocking lever can be decreased so as to easily repair the outer door handle while maintaining the lock condition of the door lock.

The door may be a back door, and the arm portion may comprise a pair of arms. In addition, the outer panel may have an operating opening for receiving the pair of arms therein. Moreover, the engaging piece may be located so as to face the inclined portion at a location neighboring the lower end of the inclined portion.

In addition, the engaging piece may be offset from the base end portion of the operating lever in lateral directions of the vehicle. In this case, since there is the gap between the engaging piece and the base end portion of the operating lever in the lateral directions of the vehicular body, the engaging piece sliding up on the inclined portion does not strike the base end portion of the operating lever, so that it is possible to even greatly restrain the deformation of the engaging piece.

Moreover, the engaging piece may be inclined so as to extend upwards while extending toward the arm portion so that the engaging piece can easily slide up on the inclined portion.

According to another aspect of the present invention, an outer door handle structure for a door of an automotive vehicle, comprises: a manually operable outer door handle mounted on an outer panel of a door of an automotive vehicle; first and second arm portions spaced at an interval in a horizontal direction to pass through operating openings, one ends of the first and second arm portions being secured to the outer door handle, and the other ends of the first and second of arm portions being pivotably supported inside of the outer panel; an operating lever pivotably supported on the first arm portion, the operating lever having a preset rotational stroke which is transmitted to a door lock for unlocking the door; and means for biasing the first and second arm portions toward the inside of the door so that the outer door handle contacts portions surrounding the operation openings when the outer door handle is not operated, the outer door handle rotating to contact the upper end portions surrounding the operation openings when the outer door handle is operated, wherein the first arm portion is allowed to rotate by a preset quantity of rotational stroke necessary to unlock the door, and the second arm portion is allowed to rotate by a greater quantity of rotational stroke than that of the first arm portion.

In this outer door handle structure, if the operating force applied to the outer door handle is biased toward the second arm portion, although the outer door handle is deformed so as to be twisted, the quantity of rotational stroke of the second arm portion is greater than that of the first arm portion. Therefore, if the quantity of rotation of the first arm portion is not the same as that of the second arm portion due to the rotation loss caused by the torsional deformation, the rotation of the first arm portion having the small quantity of rotational stroke can be surely completed, and it is possible to obtain the quantity of stroke necessary to unlock the door. Accordingly, in order to increase the strength of the outer door handle, it is not required to form the outer door handle of a metal and to increase the sectional area thereof unlike conventional outer door handles, so that it is possible to decrease the weight and cost thereof.

The rotational stroke of the operating lever may be directly transmitted to the door lock, or indirectly transmitted thereto via a transmission mechanism. The door may be a back door.

In addition, the second arm portion may have a recessed portion at a location, at which the second arm portion contacts the upper end portion the operating opening, so that the quantity of rotational stroke of the second arm portion is greater than that of the first arm portion. Alternatively, the upper end portion of the operating opening may have a recessed portion so that the quantity of rotational stroke of the second arm portion is greater than that of the first arm portion. In these cases, it is not required to increase the space occupied by the arm portions since the quantity of rotational stroke of the second arm portion is increased.

The outer door handle structure may further comprise: a base portion mounted on the outer panel and having the operating opening; and a bracket projecting from the base portion toward the inside of the door, the other ends of the first and second of arm portions being pivotably supported on the bracket. In this case, since the arm portions of the outer door handle can be directly mounted on the base portion having the operating openings, the relationship between the positions of the operating openings and the arm portions can be accurately designed, and there is no error in the rotational strokes of the arm portions.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to these specific embodiments, but are for explanation and understanding only.

In the drawings.

DESCRIPTION OF THE PREFERRED EMBODIMENTS

Figure 1:
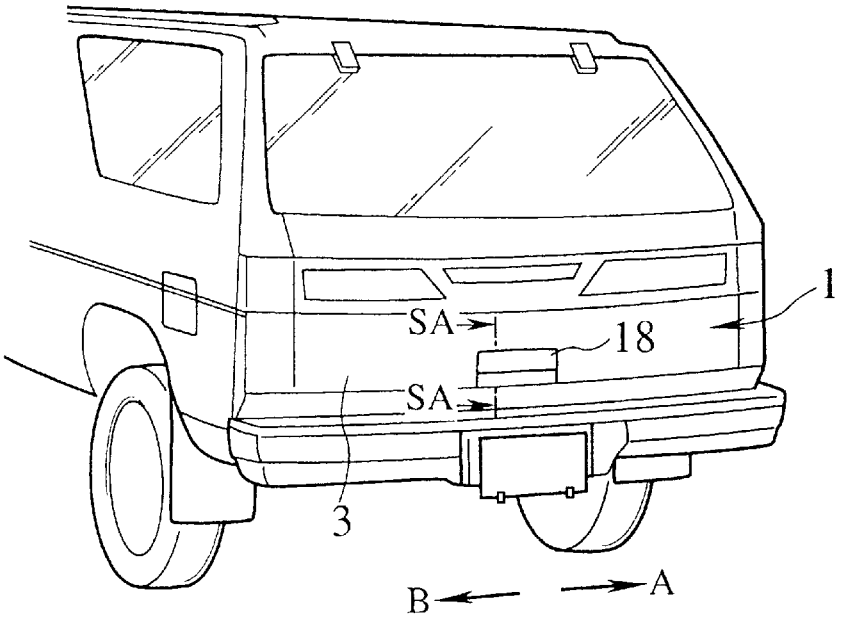
FIG. 1 is a perspective view illustrating a rear portion of an automotive vehicle, to which the preferred embodiments of an outer door handle structure for a back door of the automotive vehicle, according to the present invention, are applied.

Referring now to the drawings, particularly to FIGS. 1 through 4, the first preferred embodiment of an outer door handle structure for a back door of an automotive vehicle, according to the present invention, will be described below. Furthermore, in the drawings, arrow A indicates the right side of the vehicle and arrow B indicates the left side thereof.

As shown in FIG. 1, a back door 1 is mounted on a vehicular body via hinges so that it can rotate upwards so as to be open. As can be clearly seen from FIG. 3, the back door 1 comprises an outer panel 3 and an inner panel 4. A door lock 6 is secured to the bottom portion of the back door 1 via a reinforcing member 5. The door lock 6 is designed to engage a striker 8 provided on a rear panel 7 of the vehicular body for maintaining the closed condition of the back door 1. The door lock 6 is provided with an unlocking lever 9 which is pivotable around a supporting point 9*a*. Above the unlocking lever 9, an engaging piece 10 is arranged. As can be clearly seen from FIG. 2, the engaging piece 10 is a sector piece. As shown in FIG. 3, the tip portion 10*a* of the engaging piece 10 is inclined upwards. When the engaging piece 10 is depressed, the door lock 6 is designed to unlock the back door 1.

The outer panel 3 has a mounting hole 11 in which a resin base portion 13 is mounted via a rubber member 12. The base portion 13 has a greater width than that of the mounting hole 11 so as to extend in lateral directions of the vehicular body. As can be clearly seen from FIG. 2, both ends of the base portion 13 are secured to the outer panel 3 by means of a pair of bolts 14*a* and 14*b*. The base portion 13 has a pair of operating openings 15*a* and 15*b* on the right and left sides thereof. As shown in FIG. 3, another rubber member 16 is so arranged as to surround the operating openings 15*a* and 15*b*. In addition, a pair of brackets 17*a* and 17*b* project from the inner surface of the base portion 13 at locations neighboring the operating openings 15*a* and 15*b* so as to extend upwards.

An outer door handle 18 operated as "a direct operation system" is arranged at a location neighboring the lower end portion of the back door 1. The outer door handle 18 is designed to be manually operated by pulling up by an operator. A pair of arm portions 19*a* and 19*b* are provided on the inner surface of the outer door handle 18 so as to be spaced in a predetermined interval in the lateral direction of the vehicular body. The arm portions 19*a* and 19*b* are received in the operating openings 15*a* and 15*b* of the base portion 13. The tip portions of the arm portions 19*a* and 19*b* are pivotably supported on the upper end portions of the brackets 17*a* and 17*b* via a supporting pin 20. The left bracket 17*b* is associated with the right arm portion 19*a* by means of a spring 21 supported on the supporting pin 20. The arm portions 19*a* and 19*b* are biased toward the inside of the back door 1 by means of the spring 21. Therefore, when the outer door handle 18 is not operated by the operator, the outer door handle 18 contacts the peripheral portions of the operating openings 15*a* and 15*b* via the rubber member 16 due to the biasing force of the spring 21 (see FIG. 3).

On the left arm portion 19*b*, a base end portion 22*a* of an operating lever 22 is mounted. The operating lever 22 is a crank-shaped lever, the tip portion of which projects to the left of the vehicular body (to the right in FIG. 2). As shown in FIG. 3, the tip portion of the operating lever 22 is covered by a resin cap 23. Beneath the resin cap 23, the engaging piece 10 of the unlocking lever 9 is located. When the operating lever 22 is rotated downwards to cause the resin cap 23 to directly depress the engaging piece 10 of the unlocking lever 9, the door lock 6 is disconnected from the striker 8. Thus, since the engaging piece 10 is directly depressed by the operating lever 22 in this preferred embodiment, it is possible to omit any transmission mechanisms such as a rod in the conventional indirect system, so that it is possible to decrease the number of parts and the weight thereof.

As shown in FIG. 3, the left arm portion 19*b* facing the unlocking lever 9 has an inclined portion 24*b* which extends upwards from a location facing the tip portion 10*a* of the engaging piece 10 of the unlocking lever 9 and which is inclined upwards by a predetermined angle θ when the outer door handle 18 is not operated. Furthermore, while the right arm portion 19*a* also has an inclined portion 24*a* which is the same as the inclined portion 24*b* in this embodiment, only the left arm portion 19*b* needs to have the inclined portion 24*b* according to the present invention.

Figure 2:
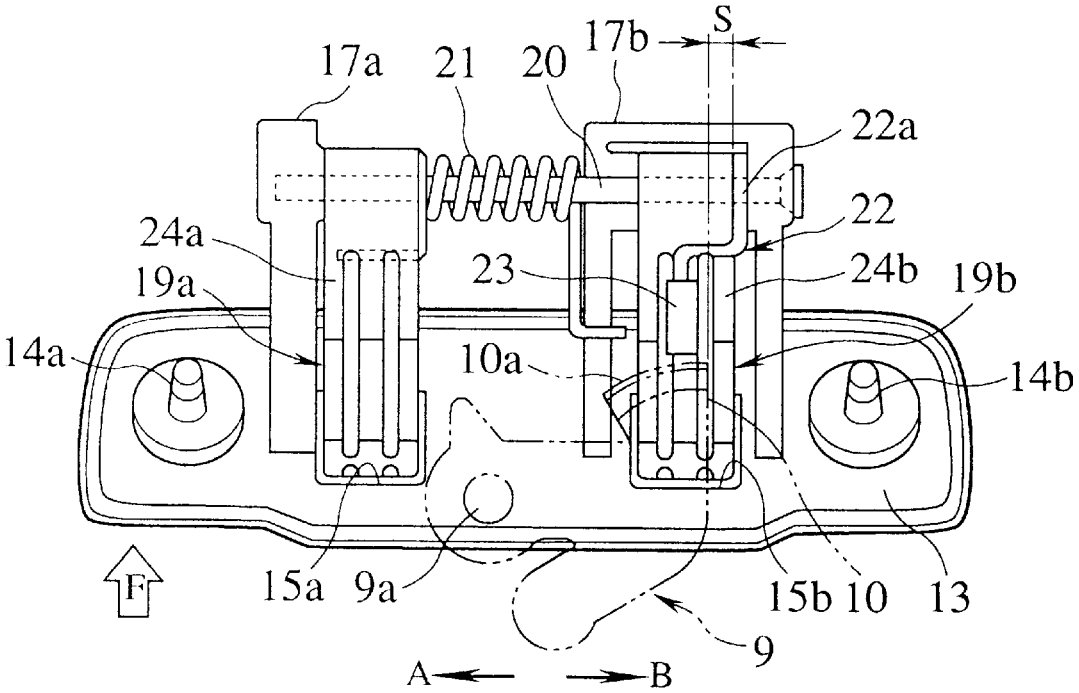
FIG. 2 is a view of the outer door handle structure of FIG. 1 viewed along arrow DA in FIG. 3.
Figure 3:
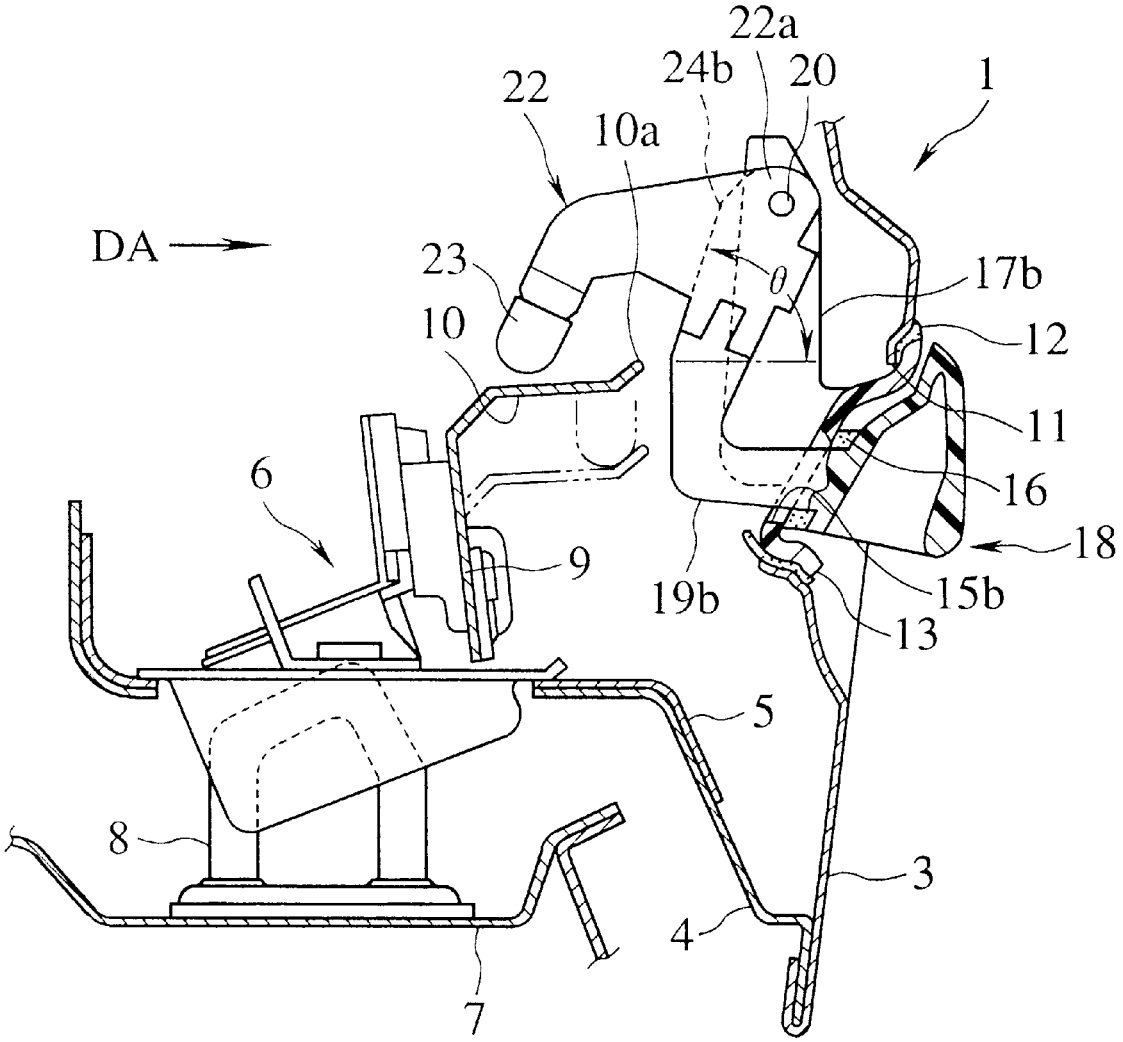
FIG. 3 is a sectional view of the outer door handle structure taken along line SA—SA in FIG. 1.

In this preferred embodiment, as shown in FIG. 2, a gap S between the engaging piece 10 of the unlocking lever 9 and the operating lever 22 is ensured in the lateral directions of the vehicular body. That is, the engaging piece 10 is designed so as not to overlap with the base end portion 22*a* of the operating lever 22 in the lateral directions of the vehicular body.

Figure 4:
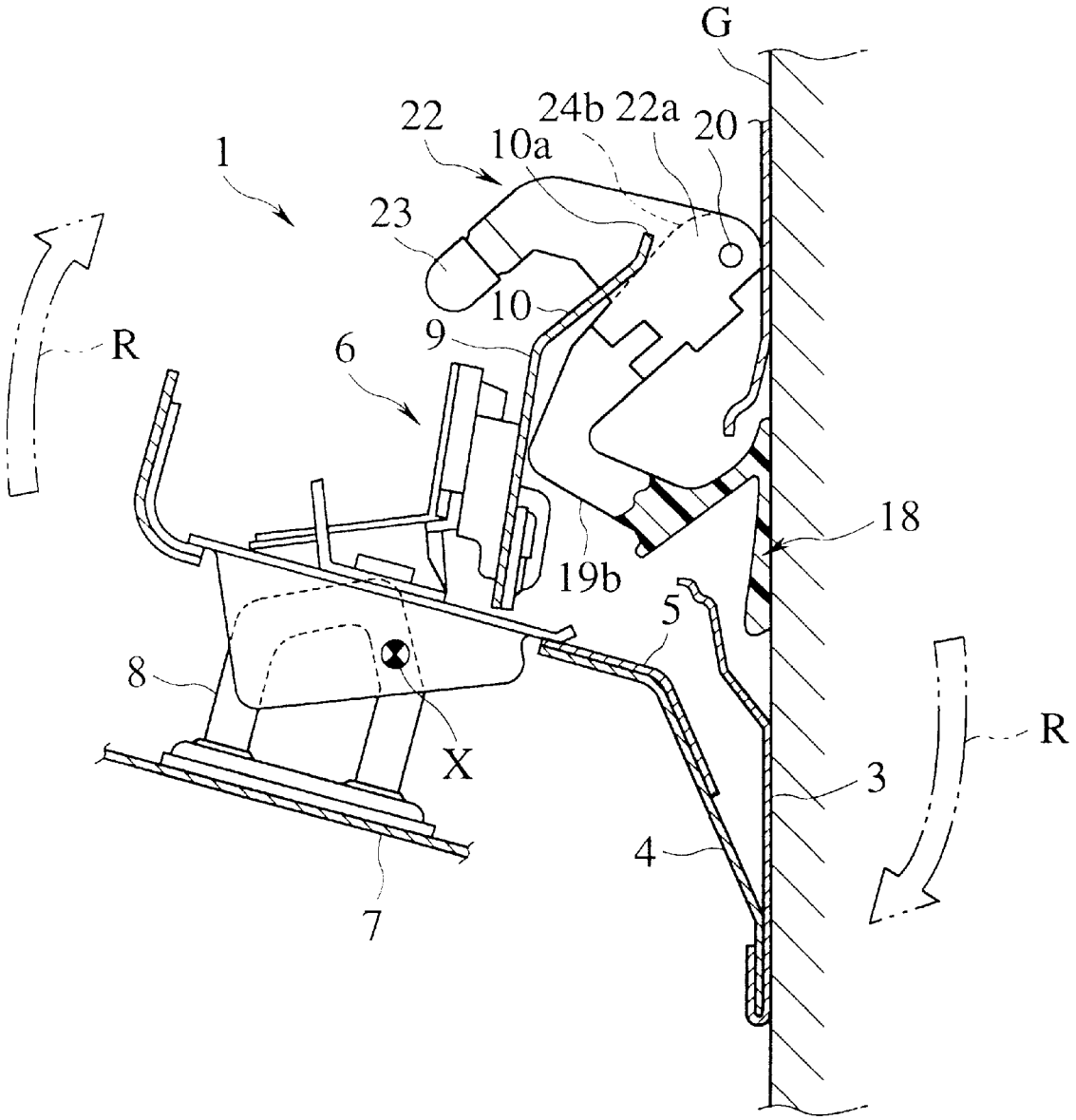
FIG. 4 is a sectional view of the outer door handle structure when a load is applied thereto.

FIG. 4 illustrates the outer door handle structure when an obstacle G collides with the back door 1.

When the obstacle G collides with the back door 1, the outer door handle 18 and the structure surrounding the door lock 6 are deformed so as to rotate in the direction of arrow R around an engaging point X at which the door lock 6 engages the striker 8. Then, the obstacle G presses the arm portions 19*a* and 19*b* of the outer door handle 18 against the engaging piece 10 of the unlocking lever 9. Then, the engaging piece 10 slides up on the inclined portion 24*b* of the left arm portion 19*b*, since the arm portion 19*b* has the inclined portion 24*b* inclined upwards by the predetermined angle θ and the tip portion 10*a* is inclined upwards.

Therefore, the deformation of the engaging piece 10 is not complex. Since the engaging piece 10 can escape upwards along the inclined portion 24*b*, the impact load by the obstacle G is not directly transmitted to the door lock 6 via the engaging piece 10, so that it is possible to prevent the failure of the door lock 6. Thus, since the deformations of the engaging piece 10 and the door lock 6 themselves can be decreased, it is possible to easily repair the outer door handle structure. In addition, since the engaging piece 10 slides up on the inclined portion 24*b* of the arm portion 19*b* so as not to be depressed, the locking condition of the door lock 6 is maintained. Moreover, since there is the gap S between the engaging piece 10 and the base end portion 22*a* of the operating lever 20 in the lateral directions of the vehicular body, the engaging piece 10 sliding up on the inclined portion 24*b* does not strike the base end portion 22*a* of the operating lever 22, so that it is possible to even greatly restrain the deformation of the engaging piece 10.

While the outer door handle 18 have been had two arm portions 19*a* and 19*b* in the aforementioned embodiment, it may have a single wider arm portion.

Referring to FIGS. 5 through 8, the second preferred embodiment of an outer door handle structure for a back door of an automotive vehicle, according to the present invention, will be described below.

Figure 5:
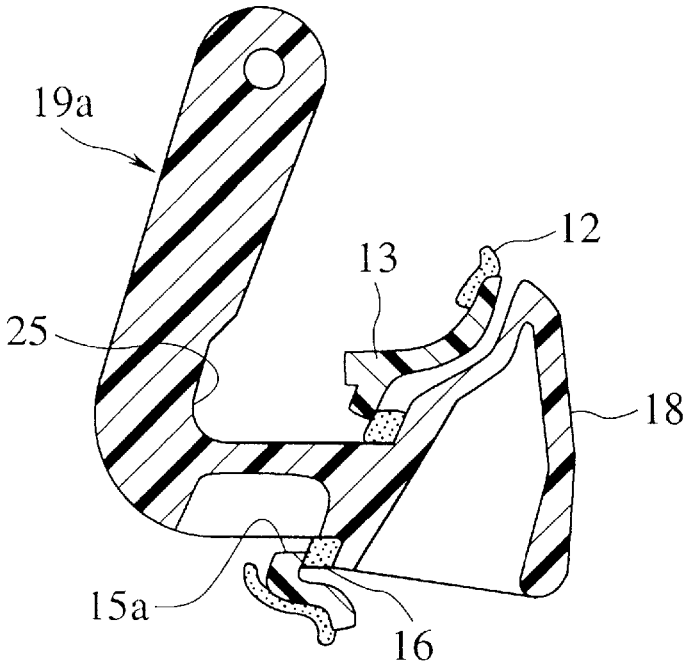
FIG. 5 is an enlarged sectional view of an arm portion in the second preferred embodiment of an outer door handle structure for a back door of an automotive vehicle, according to the present invention, when the outer door handle is not operated.
Figure 6:
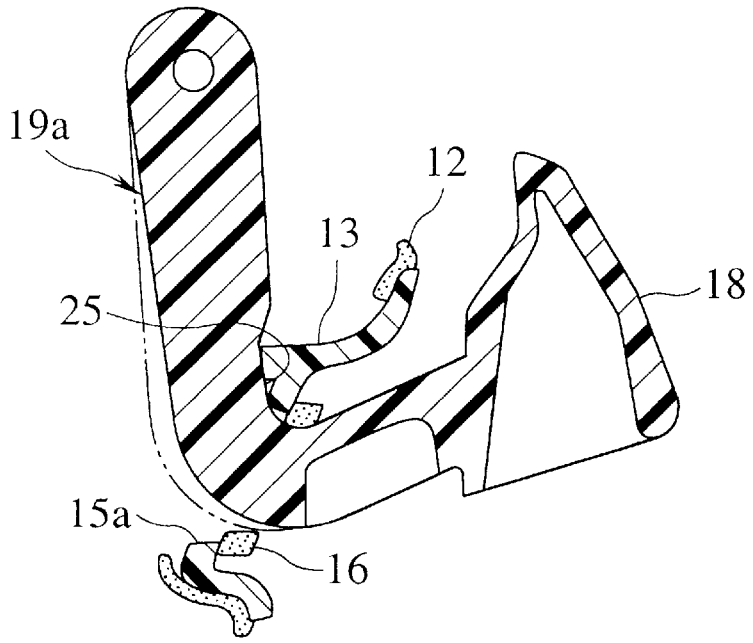
FIG. 6 is an enlarged sectional view of the arm portion of FIG. 5 when the outer door handle is operated.

This preferred embodiment is the same as the first preferred embodiment, except that the right arm portion 19*a* on which the operating lever 22 is not mounted has a recessed portion 25 at a location at which the right arm portion 19 contacts the upper end portion of the operating opening 15*a* as shown in FIGS. 5 and 6.

Figure 7:
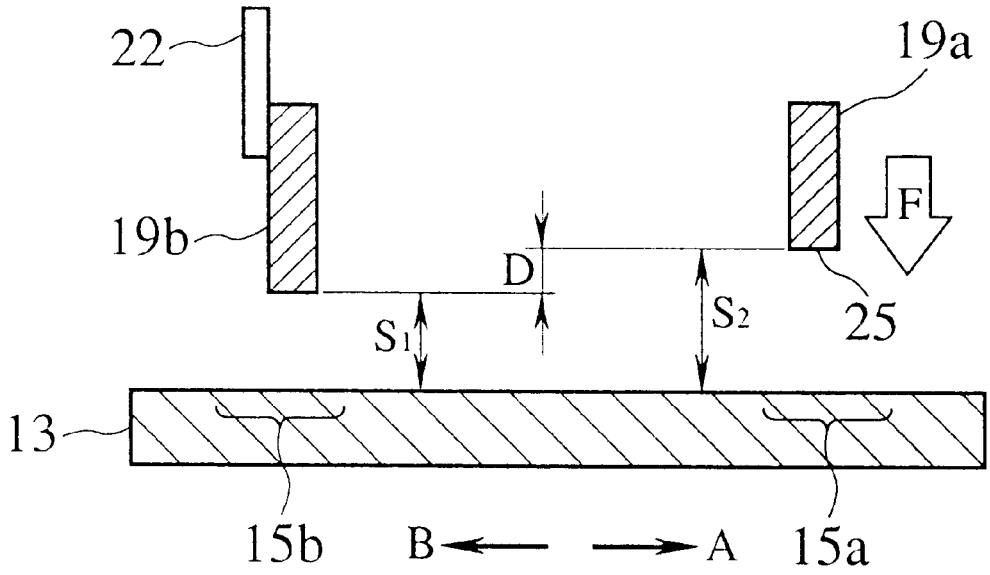
FIG. 7 is a view illustrating the relationship between the arm portion and a base portion when the outer door handle is not operated in the second preferred embodiment.
Figure 8:
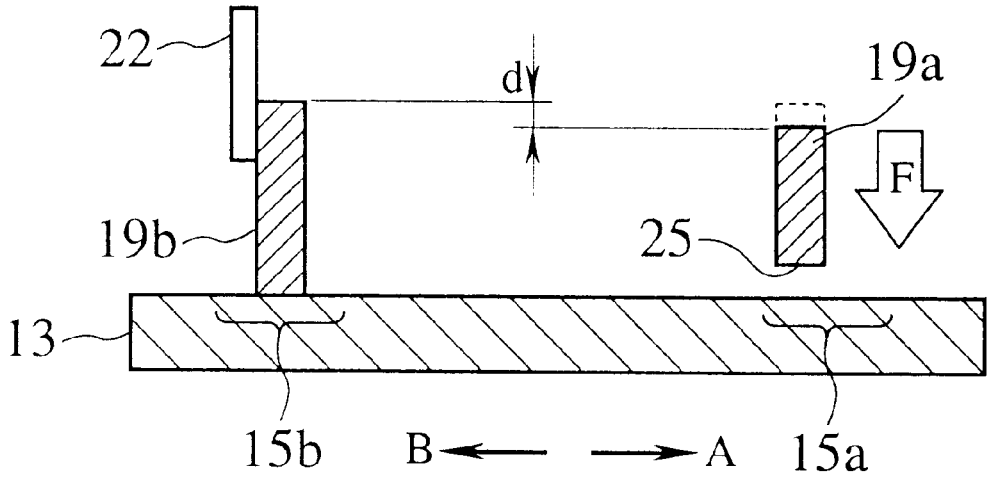
FIG. 8 is a view illustrating the relationship between the arm portion and the base portion when the outer door handle is operated in the second preferred embodiment.

As shown in FIG. 7, when the outer door handle 18 is pulled up, the left arm portion 19*b*, together with the operating lever 22, rotates by a preset quantity S1 of rotational stroke so as to depress the unlocking lever 9 as mentioned above. When the outer door handle 18 is operated, although the left arm portion 19*b* rotates by the preset quantity S1 of rotational stroke so as to contact the upper end portion of the base portion 13, this quantity S1 of rotational stroke is preset to be a value necessary to surely depress the unlocking lever 9.

On the other hand, as shown in FIGS. 5 and 6, the right arm portion 19*a* on which the operating lever 22 is not mounted has the recessed portion 25 at the location at which the right arm portion 19 contacts the upper end portion of the operating opening 15*a*, and the quantity S2 of rotational stroke of the right arm portion is set to be greater than the quantity S1 of rotational stroke of the left arm portion 19*b*. That is, between the quantity S1 of rotational stroke of the left arm portion 19*b*, the quantity S2 of rotational stroke of the right arm portion 19*a* and the depth D of the recessed portion 25, there is the relationship "S2=S1+D", taking account of the case that the operating force F applied to the outer door handle is biased toward the right end portion thereof when the right end portion of the outer door handle 18 is pulled up by the operator's hand. Furthermore, the two-dot chain line in FIG. 6 indicates the arm portion 19*a* when the recessed portion 25 is not formed.

That is, when the operating force F applied to the outer door handle 18 is biased toward the right end portion thereof, the outer door handle 18 is deformed so as to be twisted. However, according to this preferred embodiment, the quantity S2 of rotational stroke of the right arm portion 19*a*, to which the operating force F is applied, is set to be greater than the quantity S1 of rotational stroke of the left arm portion 19*b*. Therefore, if the quantity of rotation of the left arm portion 19*b* is not the same as that of the right arm portion 19*a* due to the rotation loss d (see FIG. 8) caused by the torsional deformation, the rotation of the left arm portion 19*b* having the small quantity S1 of rotational stroke can be surely completed, and the left arm portion 19*b* can first stroke the upper end portion of the operating opening 15*b*.

Furthermore, although the rotation loss d caused by the torsional deformation of the outer door handle 18 varies due to the biasing force of the spring 21 or the operating force F, the left arm portion 19*b* always strikes the upper end portion of the operating opening 15*b* before the right arm portion 19*a* strikes it if the relationship "depth D of the recessed portion 25≧rotation loss d" is set. As mentioned above, since the left arm portion 19*b* is preset so as to have the quantity S1 of rotational stroke necessary to unlock the door lock 6, it is possible to surely unlock the door lock 6 by bringing the left arm portion 19*b* into contact with the upper end portion of the operating opening 15*b* to rotate the left arm portion 19 by the whole quantity S1 of rotational stroke. However, since the arm portion 19*b* on which the operating lever 22 is mounted is usually designed to unlock the door lock 6 immediately before contacting the upper end portion of the operating opening 15*b*, the aforementioned relationship "depth D of the recessed portion 25≧rotation loss d" is not always indispensable requirement.

In this preferred embodiment, the recessed portion 25 is only formed in the right arm portion 19*a* having the same shape of that in the first preferred embodiment. Therefore, it is not required to increase the space occupied by the arm portions 19*a* and 19*b* inside of the back door 1, and it is possible to easily design the door lock 6 and the other parts.

Figure 9:
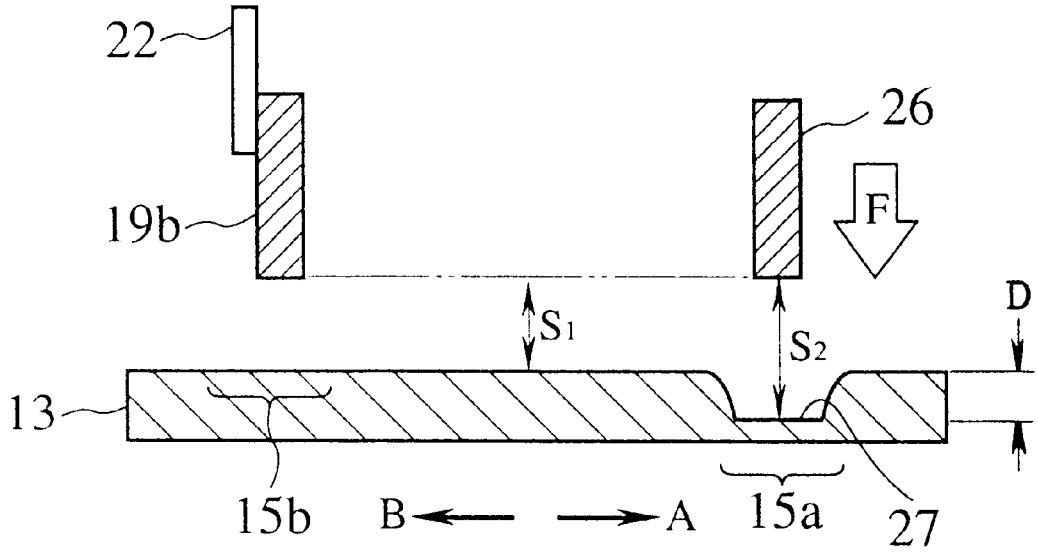
FIG. 9 is a view illustrating the relationship between the arm portion and the base portion when the outer door handle is not operated in the third preferred embodiment.
Figure 10:
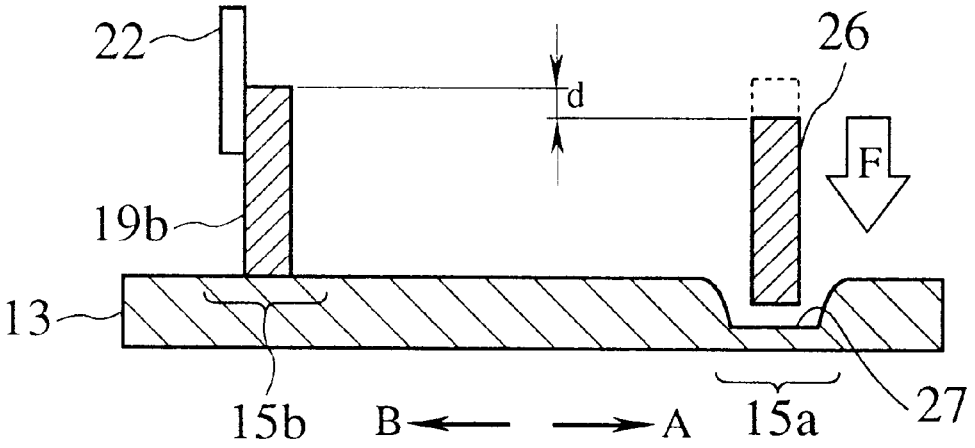
FIG. 10 is a view illustrating the relationship between the arm portion and the base portion when the outer door handle is operated in the third preferred embodiment.

Referring to FIGS. 9 and 10, the third preferred embodiment of an outer door handle structure for a back door of an automotive vehicle, according to the present invention, will be described below.

In this preferred embodiment, no recessed portion is formed in a right arm portion 26 corresponding to the right arm portion 19*a*, and a recessed portion 27 having a predetermined depth D is formed in the upper end portion of the operation opening 15*a*, which contacts the right arm portion 26. Specifically, the thickness of the base portion 13 is decreased at the portion facing the right arm portion 26 so as to form the recessed portion 27. Therefore, there is the relationship "the quantity S2 of rotational stroke of the right arm portion 26 is equal to the quantity Sl of rotational stroke of the left arm portion 19*b* plus the depth D of the recessed portion 27", so that the same advantageous effect as that of the second preferred embodiment can be obtained. Similar to the second preferred embodiment, in this preferred embodiment, it is not required to increase the space occupied by the arm portions 26 and 19*b* inside of the back door 1, and it is possible to easily design the door lock 6 and the other parts.

In the second and third preferred embodiments, while the operating lever 22 has been mounted on the left arm portion 19*b* and the right arm portion 19*a* or while the upper end portion of the operating opening 15*a* has been formed with the recessed portion 25 or 27, the right and left may be reversed.

In addition, in the second and third preferred embodiments, while the right arm portion 19*a* has been formed with the recessed portion 25 or the upper end portion of the operating opening 15*a* has been formed with the recessed portion 27 in order to prevent the increase of the space occupied by the arm portions 19*a* or 26 and 19*b*, the right arm portion 19*a* or 26 may be located inside of the left arm portion 19*b* in order to increase the quantity of rotational stroke of the right arm portion 19*a* or 26 if there is a sufficient space inside of the door.

In the aforementioned preferred embodiments, while the base portion 13 has been provided with the operating openings 15*a* and 15*b* to be secured to the outer panel 3, the base portion 13 may be omitted to directly form the "operating openings" in the outer panel 3, so that the arm portions 19*a* and 19*b* of the outer door handle 18 may be inserted into the interior of the back door 1 via the "operating openings" so as to be pivotably supported.

While the back door 1 has been described as a "vehicular door" in the aforementioned preferred embodiments, the present invention may be also applied to a side door. In addition, the present invention can not only be applied to a pivotable door, but it can also be applied to a slidable door. Moreover, while the door lock has had the unlocking lever 9 which is designed to be directly depressed by the operating lever 22 mounted on the arm portion 19*b* of the outer door handle 18, the operating lever 22 may be indirectly connected to the unlocking lever 9 via a rod.

What is claimed is:

1. An outer door handle structure for a door of an automotive vehicle, comprising:

a base portion adapted to be mounted on an outer panel of a door of an automotive vehicle and having operating openings;

a manually operable outer door handle;

first and second arm portions spaced from each other and passing through said operating openings, one end of each of said first and second arm portions being secured to said outer door handle, and the other end of each of said first and second arm portions being adapted for placement inside of the outer panel, the first and second arm portions being pivotably supported so as to rotate into contact with end portions of the operating openings upon operation of said outer door handle;

an operating lever connected to said first arm portion, said operating lever having a preset rotational stroke and being configured to transmit its rotational stroke to a door lock; and means for biasing said first and second arm portions so that said outer door handle contacts portions surrounding said operating openings when said outer door handle is not operated, wherein said second arm portion has a recessed portion at a location at which said second arm portion contacts the end portion of the operating opening through which the second arm portion extends, and wherein said operating openings are configured to permit said first arm portion to rotate through a preset rotational stroke and to permit said second arm portion to rotate through a rotational stroke that is larger than the preset rotational stroke of said first arm portion.

2. An outer door handle structure for a door of an automotive vehicle, comprising:

a base portion adapted to be mounted on an outer panel of a door of an automotive vehicle and having, operating openings;

a manually operable outer door handle;

first and second arm portions spaced from each other and passing through said operating openings, one end of each of said first and second arm portions being secured to said outer door handle, and the other end of each of said first and second arm portions being adapted for placement inside of the outer panel, the first and second arm portions being pivotably supported so as to rotate into contact with end portions of the operating openings upon operation of said outer door handle;

an operating lever connected to said first arm portion, said operating lever having a preset rotational stroke and being configured to transmit its rotational stroke to a door lock; and means for biasing said first and second arm portions so that said outer door handle contacts portions surrounding said operating openings when said outer door handle is not operated, wherein one of said end portions of said operating openings has a recessed portion, and wherein said operating openings are configured to permit said first arm portion to rotate through a preset rotational stroke and to permit said second arm portion to rotate through a rotational stroke that is larger than the preset rotational stroke of said first arm portion.

3. An outer door handle structure for vehicles having a vehicle body, a door and a door lock assembly for locking the door to the vehicle body, the outer door handle structure comprising:

an unlock element configured to operate a door lock assembly to unlock a door of a vehicle;

a door handle member rotatable and flexible in a first direction, the door handle member comprising:

a first integral portion having the unlock element secured thereto; and a second integral portion spaced from the first integral portion in a second direction which intersects the first direction;

a stop element defining a first range of rotation for the door handle member; and flexure allowance means for allowing the second integral portion of the door handle member to flex within a second range of rotation which is greater than the first range of rotation, wherein the flexure allowance means comprises a recess formed in the second integral portion of the door handle member.

4. An outer door handle structure for vehicles having a vehicle body, a door and a door lock assembly for locking the door to the vehicle body, the outer door handle structure comprising:

an unlock element configured to operate a door lock assembly to unlock a door of a vehicle;

a door handle member rotatable and flexible in a first direction, the door handle member comprising:

a first integral portion having the unlock element secured thereto; and a second integral portion spaced from the first integral portion in a second direction which intersects the first direction;

a stop element defining a first range of rotation for the door handle member; and flexure allowance means for allowing the second integral portion of the door handle member to flex within a second range of rotation which is greater than the first range of rotation, wherein the flexure allowance means comprises a recess formed in the stop element.

* * * * *